US005146849A

United States Patent [19]

Johenning, II

[11] Patent Number: 5,146,849

[45] Date of Patent: Sep. 15, 1992

[54] PRINT HEAD, MOUNTING THEREFOR AND METHOD OF MOUNTING

[75] Inventor: Leon C. Johenning, II, Lexington, Va.

[73] Assignee: Genicom Corporation, Waynesboro, Va.

[21] Appl. No.: 583,247

[22] Filed: Sep. 17, 1990

Related U.S. Application Data

[63] Continuation-in-part of Ser. No. 241,310, Sep. 7, 1988.

[51] Int. Cl.[5] ..... B41J 2/245

[52] U.S. Cl. ..... 101/93.05; 400/175

[58] Field of Search ..... 101/93.04, 93.05, 93.29, 101/93.48; 400/121, 124, 157.2, 175

[56] References Cited

U.S. PATENT DOCUMENTS

| | | | |
|---|---|---|---|
| 3,967,714 | 7/1976 | Potma | 101/93.05 |
| 3,983,806 | 10/1976 | Ishi | 101/93.48 |
| 4,211,494 | 7/1980 | Fischer et al. | 101/93.05 |
| 4,239,402 | 12/1980 | Jung et al. | 400/175 |
| 4,278,020 | 7/1981 | Oaten | 101/93.05 |
| 4,309,116 | 1/1982 | Maeda | 101/93.05 |
| 4,350,450 | 9/1982 | Durr et al. | 101/93.05 |
| 4,441,830 | 4/1984 | Italiano | 400/124 |
| 4,462,706 | 7/1984 | Matschke | 400/124 |
| 4,468,142 | 8/1984 | Berrey et al. | 101/93.05 |
| 4,532,862 | 8/1985 | Moss | 101/93.48 |
| 4,651,640 | 3/1987 | Bohg et al. | 101/93.48 |
| 4,832,516 | 5/1989 | Nagasawa et al. | 400/124 |

FOREIGN PATENT DOCUMENTS

| | | | |
|---|---|---|---|
| 137165 | 8/1982 | Japan | 101/93.05 |
| 177374 | 10/1983 | Japan | 101/93.05 |
| 17214 | 1/1984 | Japan | 101/93.05 |
| 95321 | 5/1987 | Japan | 101/93.04 |
| 2157621 | 10/1985 | United Kingdom | 101/93.05 |

*Primary Examiner*—David A. Wiecking
*Attorney, Agent, or Firm*—Nixon & Vanderhye

[57] ABSTRACT

The print head includes a print head support, a pair of actuators on one side of the support, and wire guide supports on the opposite side of the print head support for clamping the actuators and wire guide supports to the print head support. The wire guide supports have diameters equal to the centerline-to-centerline spacing of the print wires. The print head support has a linear surface extending perpendicular to a plane passing along the edges of the wire guide supports. The print heads are aligned along a support member by securing the print head support to the support member with the tangent plane and linear surface engaging mutually perpendicular surfaces on the support member whereby the contact between the wire guide supports along the support member establishes the centerline-to-centerline spacing of the print wires. The print head support is secured to the support member by a single bolt, thereby enabling removal of a defective actuator by removal of the support with the defective and a serviceable actuator for replacement.

23 Claims, 2 Drawing Sheets

48
50
62
64
28
26
56
46
44
42
24
34
22
32
40
20
36
16
42
44
18
30
38

38
44
36
42
10
76
46
56
68
72
48
70
78

A
58
60
10

48
A
54
52

PRINT HEAD, MOUNTING THEREFOR AND METHOD OF MOUNTING

RELATED APPLICATIONS

This application is a continuation-in-part of U.S. patent application Ser. No. 07/241,310, filed Sept. 7, 1988 and of common assignee herewith.

BACKGROUND OF THE INVENTION

The present invention relates generally to print heads having electromagnetic print wire actuators for use in a dot matrix printer and particularly to the print heads, the mounting for the print heads and a method of assembling the print heads on a printer carriage.

Conventional print heads for dot matrix printers typically employ a substantial number of actuators, for example, 6, 11 or 22, mounted behind a long wire guide. The wire guide is normally a flat plate with print wire holes accurately machined to provide precise centerline-to-centerline spacing for the print wires. Alternatively, the print wires may be accurately spaced using a special service gauge. Each actuator normally includes an electromagnetic coil which, when actuated, drives a piston along a bore driving a print wire in front of the piston against the bias of a spring. Of course, the advance of the print wire causes it to engage an ink transfer medium (e.g., an inked ribbon) and apply a dot to a print medium (e.g., paper). By properly timing the individual print wire drive pulses to each actuator in conjunction with paper and print head movements, a printed dot of ink can be placed at virtually any desired location on the paper, thus to form alphanumeric or other symbols, as is well known in the art. Typically, one or more print heads are mounted on a shuttle which rapidly oscillates in a horizontal direction while the paper is indexed in a transverse direction each time the print head nears one of its horizontal travel limits. Typically, the print actuator array is oscillated at an amplitude which is slightly more than the regular spacing between print wires in the print head so as to permit placement of a dot at every possible dot position along a given print line before the paper is indexed to a new dot print line.

One common goal in the design of actuators is to make them as small as possible because of the need to array a plurality of the actuators in a relatively small volume to facilitate close spacing of individual print wires within a dot matrix print head. It is quite common, therefore, to provide print heads having a substantial number of actuators. When multiple print heads each comprising a large number of actuators, i.e., six or more, are mounted to or behind a long wire guide with accurately pre-positioned print wire holes, it is frequently necessary to replace the entire print head, including all of the six of more actuators, as a result of the failure of but one actuator. Accuracy in the initial placement and the replacement of the print head is also required and difficult to attain. Further, the spacing between print wires of various printers is also different one from the other, requiring accurate machining of precisely spaced holes along the long wire guide for receiving the print wires. Even where service gauges are used to space the actuators, this is a laborious and oftentimes inaccurately performed task. Consequently, these constraints render actuator and mounting designs therefor quite difficult, particularly in identifying, removing and replacing a failed actuator, in a manner to achieve precise accurate alignment of the print wires.

According to the present invention, there is provided a print head, a mounting for the print head and a method of mounting the print heads which minimizes or eliminates the foregoing and other problems associated with prior print heads, mountings therefor and methods of mounting and provides novel and improved print heads, mountings therefor and methods of assembly. Particularly, a print head according to the present invention includes a print head support for mounting a pair of actuators in side-by-side relation on one side thereof and having a pair of openings for receiving the print wires. Wire guide supports are provided on the opposite side of the print head support in line with and for receiving the print wires. The wire guide supports are preferably screw-threaded on externally threaded sleeves which extend through the print head support openings from corresponding actuators whereby threading the wire guide support onto the sleeve clamps each actuator and associated wire guide support to and on opposite sides of the print head support. A wire guide is provided adjacent the distal end of the wire guide support for receiving the wire and guiding it toward the ink transfer medium.

In accordance with the present invention, the pair of wire guide supports for each print head define a plane passing through edges thereof. More particularly, the wire guide supports are preferably cylindrical in external configuration and, when disposed side-by-side in a print head, define a horizontal plane tangent to their cylindrical configurations. The print head support also has a flat or linear extending surface which forms a predetermined angle, preferably a right angle, with the tangent plane. Consequently, the print head has surfaces accurately defining a predetermined, preferably right, angle with one another for facilitating mounting of the print heads to the shuttle carriage in a dot matrix printer.

In order to mount the print head of the present invention in the printer, there is provided a bar or carriage, carried by the shuttle of the dot matrix printer, having two flat, angularly related surfaces which correspond in angular relation to the angle between the flat surface of the print head support and the tangent plane defined by the wire guide supports. These surfaces are preferably right angularly related to one another, similarly as the print head support surface and tangent plane are preferably right angularly related. Thus, the print head is applied to the bar or carriage with the wire guide supports bearing on one of the flat surfaces of the bar or carriage, i.e., in a horizontal plane, and the linear surface of the print head support bearing along the other angularly related, i.e., vertically extending, surface of the bar or carriage. The print head support may then be secured to the bar or carriage, for example, by a single screw or bolt coupling the print head support and the carriage one to the other.

It will be appreciated that the shuttle mounted carriage includes a plurality of print heads mounted in side-by-side relation to one another. By fabricating the wire guide supports to a lateral dimension, i.e., an outside diameter, corresponding identically to the centerline-to centerline spacing of the print wires, the print heads can be readily disposed side-by-side and achieve the exact and desired centerline-to centerline spacing of the print wires. Thus, in mounting the print heads, the sides of the wire guide supports abut one another and, in that relation, accurate centerline to-centerline spacing of the print wires is obtained. This mounting therefore defines a straight line of equally spaced print wires, i.e., the print wires are precisely spaced one from the other along a horizontal line.

With this construction, there is also afforded the flexibility to change the centerline-to-centerline dimension of the print wires by providing print head supports of a different size and varying the diameter of the wire guide supports. More particularly, the openings through the print head supports are spaced one from the other corresponding to the desired centerline-to-centerline spacing of the actuator wires. The wire guide supports are formed to diameters corresponding to the centerline-to-centerline spacing of the print wires. Bore holes are provided in the shuttle carriage at different elevations therealong corresponding to a number of different centerline-to-centerline spacings between print wires. The print head supports have elongated slots for securing the print heads to the carriage. Thus, by mounting the print heads along the carriage with the wire guide supports in contact with one another and securing the print heads to the carriage by bolts passing through the slots in the print head support, the mounting of print heads with different centerline-to-centerline spacing can be readily achieved.

Additionally, with the foregoing invention, there is low investment by the printer user in actuator replacement. In the present invention, only a pair of actuators is mounted to each print head support. Consequently, when an actuator fails and after the failed actuator is identified, only the print head mounting the pair of actuators containing the failed actuator need be removed and replaced. Thus, there is the expense of replacing only one additional serviceable actuator when replacing the failed actuator. This is in contrast to removing an entire array of actuators, testing them and attempting to replace the failed actuator or replacing the entire array of actuators.

In a preferred embodiment according to the present invention, there is provided a method of assembling a print head on a support frame having a pair of elongated angularly related support surfaces, the print head having a print head support with a linear surface, an actuator carried by the print head support and having an actuator wire and a wire guide support for the actuator wire mounted on the print head support and projecting therefrom to form a predetermined angle with the linear surface of the print head support, comprising the steps of mounting the print head on the support frame by engaging the wire guide support on one of the angularly related surfaces, engaging the linear surface of the print head support on the other of the angularly related surfaces of the support frame and thereafter securing the support frame and print head support one to the other.

In a further preferred embodiment according to the present invention, there is provided a print head for mounting on a support member comprising a pair of print head actuators, each actuator carrying a print wire, a print head support for mounting the pair of actuators and having openings for receiving respective print wires. Means are provided for securing the pair of actuators and the print head support one to the other on one side of the print head support with the print wires extending through the openings, with a wire guide support for each actuator and having a passage therethrough for receiving the print wire and means for retaining the wire guide support on the print head support on the opposite side thereof from the actuator, the wire guide supports lying in side-by-side relation one to the other defining a first plane passing along edge portions thereof, the print head support having a linear surface along the opposite side thereof defining a second plane angularly related to the first plane for mounting the print head on a support member having corresponding angularly related surfaces.

In a further preferred embodiment according to the present invention, there is provided a print head assembly for a dot matrix printer comprising a plurality of print heads, each print head including a pair of print head actuators each carrying a print wire, a print head support for mounting the pair of actuators and having openings for receiving respective print wires, means for securing the pair of actuators and the print head support one to the other on one side of the print head support with the print wires extending through the openings, a wire guide support for each actuator and having a passage therethrough for receiving the print wire and means for retaining the wire guide support on the print head support on the opposite side thereof from the actuator, a support member having a pair of angularly related surfaces, said print heads being disposed in side-by-side relation to one another on the support member, wire guide supports on each adjacent pair of print heads lying in side-by-side relation one to the other defining a first plane passing along edge portions thereof, each print head support having a linear surface along the opposite side thereof defining a second plane angularly related to the first plane identically as the surfaces of the support member are angularly related to one another whereby the print heads are mounted on the support member with the edge portions of the wire guide supports and the linear surfaces engaging the corresponding angularly related surfaces of the support member.

Accordingly, it is a primary object of the present invention to provide a novel and improved print head, mounting therefor and method of mounting a print head in a dot matrix printer wherein accurate alignment of the print wires in true centerline-to-centerline spacing and ready installation and replacement of print heads are achieved.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
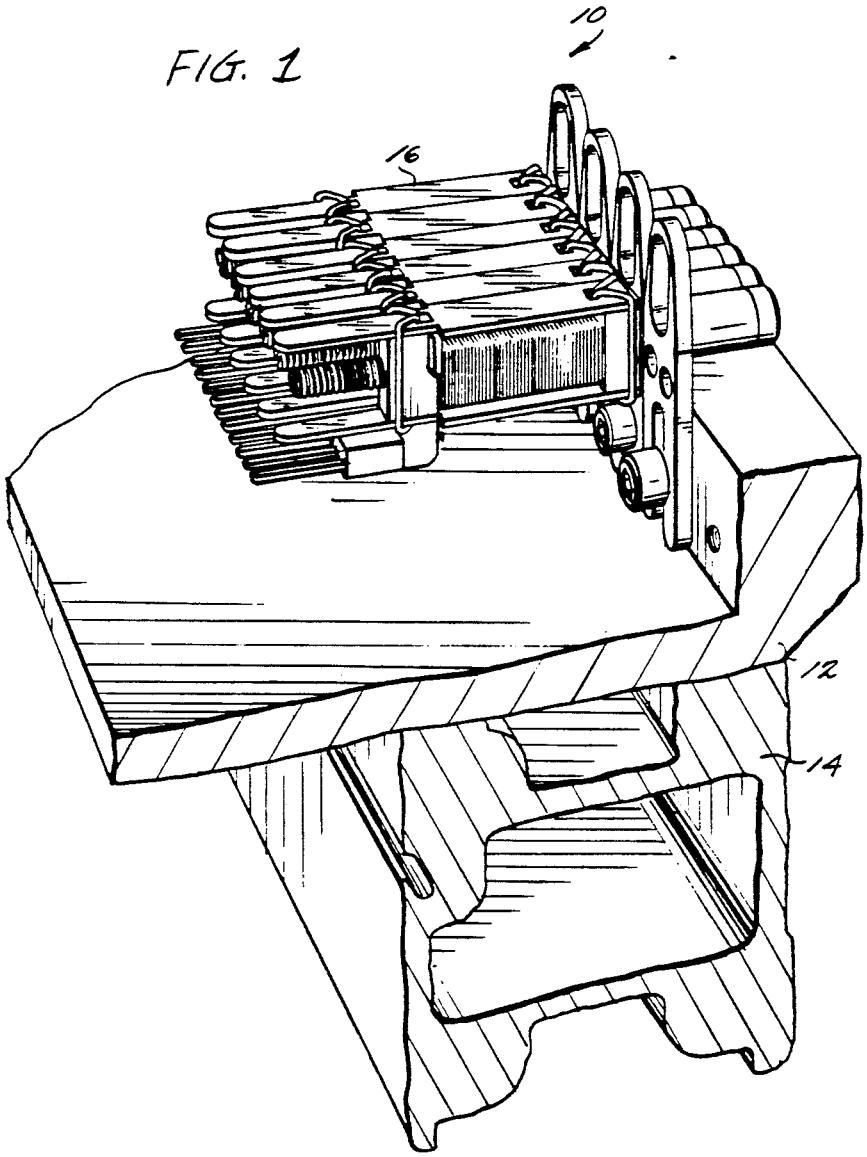
FIG. 1 is a fragmentary perspective view with portions in cross section illustrating a mounting of three print heads on a carriage forming part of a dot matrix shuttle printer.

Referring now to the drawings, particularly to FIG. 1, there is illustrated a plurality of print heads, each generally designated 10, mounted on a support frame or carriage 12, in turn mounted on a shuttle 14 for oscillation back and forth along a print line. The construction of the shuttle and the manner of its oscillation is known to those skilled in this art and a description of those aspects of a dot matrix printer is not believed necessary to an understanding of this invention. However, before describing the print heads 10 and their mounting, a brief description of the individual actuators 16 carried by the print heads 10 will be provided.

Figure 3:
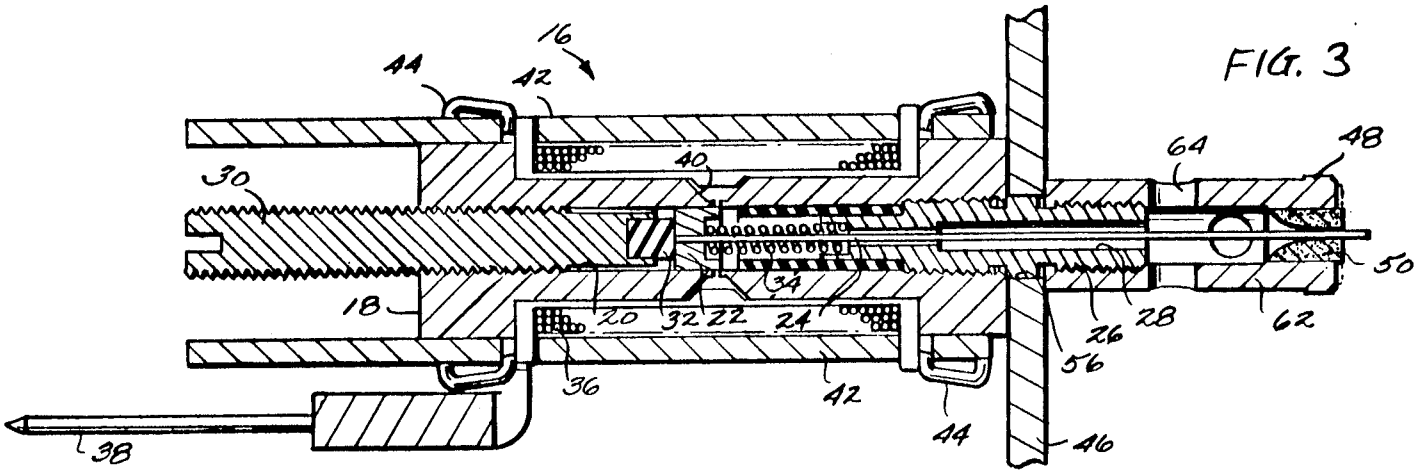
FIG. 3 is an enlarged cross-sectional view thereof taken generally about on line 3—3 in FIG. 2.

Referring now to FIG. 3, actuator 16 is essentially similar to the actuators described and illustrated in my earlier co-pending application Ser. No. 07/241,310, filed Sept. 7, 1988 and titled "Electromagnetic Print Wire Actuator and Dot Matrix Print Head Utilizing Same," the disclosure of which is incorporated herein by reference. Briefly, each actuator 16 comprises a central, generally I-shaped, magnetically permeable core 18 of generally rectangular cross-section and having a central bore 20. Within bore 20, there is mounted a piston 22 connected to a print wire 24. An externally threaded mounting sleeve 26 has a bore 28 through which the print wire 24 is received. Sleeve 26 is disposed in the forward end of bore 20 and is threadedly engaged therein with core 18. A tuning member 30 is threadedly engaged in core 18 in the rear end of bore 20. A backstop member 32 is disposed between piston 22 and tuning member 30 for determining the rest position of piston 22. A spring 34 cooperates between the forward end of piston 22 and the rear end of sleeve 26 to bias the piston and, hence, print wire 24, into a retracted position. Windings 36 are provided about core 18 and electrical energy may be provided coil 36 via connector terminals 38. A V-shaped cut 40 is provided in core 18 to define an area of lowered magnetic permeability. A return magnetic flux path is provided between the ends of the core 18 by flux return path bars 42. These bars are spring-clipped to the actuator by clips 44. Further details of a very similar actuator may be obtained by reference to the foregoing identified patent application.

It will be appreciated that when current is passed through windings 36, piston 22 is caused by magnetic forces to slide into registry with the reduced permeability portion 40 of core 18 and, thus cause print wire 24 to advance axially of core 18 against the bias of spring 34. When the drive current pulse is removed from winding 36, piston 32 is spring-biased against backstop 32 to retract print wire 24 toward the core 18.

Figure 2:
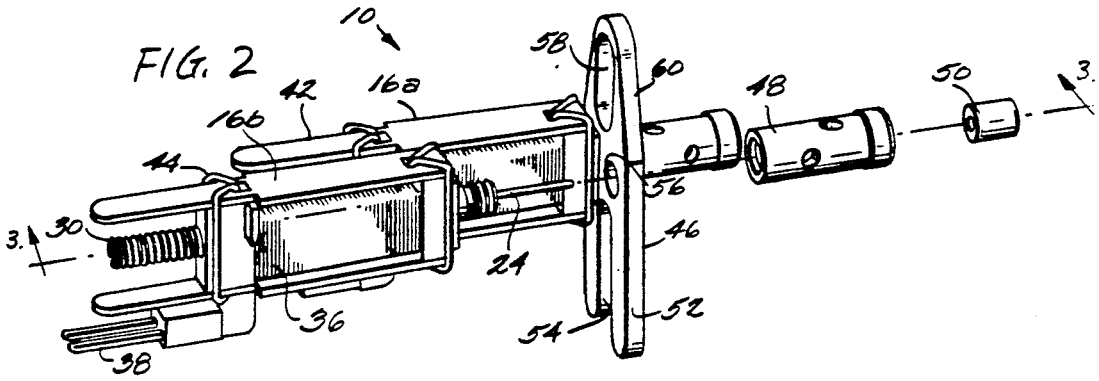
FIG. 2 is an exploded perspective view illustrating the assembly of the actuators, wire guide supports and wire guides to the print head support.

According to the present invention, each actuator constitutes one of a pair of actuators forming a print head 10. This, for example, is best illustrated in FIG. 2, wherein actuators **16*a* and 16*b* form part of a print head 10 which also includes a print head support 46, a pair of wire guide supports 48 and a pair of wire guides 50, only one of which is illustrated. Print head support 46 comprises a flat, planar plate having a pair of depending legs 52 with an elongated slot 54 therebetween, a pair of openings or apertures 56 disposed in side-by-side relation in a mid-portion of the vertical length of print head support 46 and an elongated slot 58 disposed in the upper portion of the support 46. The lateral edges 60 of the upper portion taper toward one another toward the distal end of support 46. The apertures 56 are sized and disposed to receive the mounting sleeve 26 with the externally threaded distal end of sleeve 26 projecting from the side of support 46 opposite actuator 16**.

Referring to FIGS. 2 and 3, each wire guide support member 48 includes a tubular sleeve 62 having a central bore internally threaded at one end for threaded engagement about the externally threaded distal end of sleeve 26. The opposite end of wire guide support 48 mounts the wire guide 50. A plurality of openings 64 are disposed about the wire guide support 48. Thus, the print wire 24 extends through the bore 28 of sleeve 26 into the bore of wire guide support 48 and emerges through the end of wire guide 50.

Figure 5:
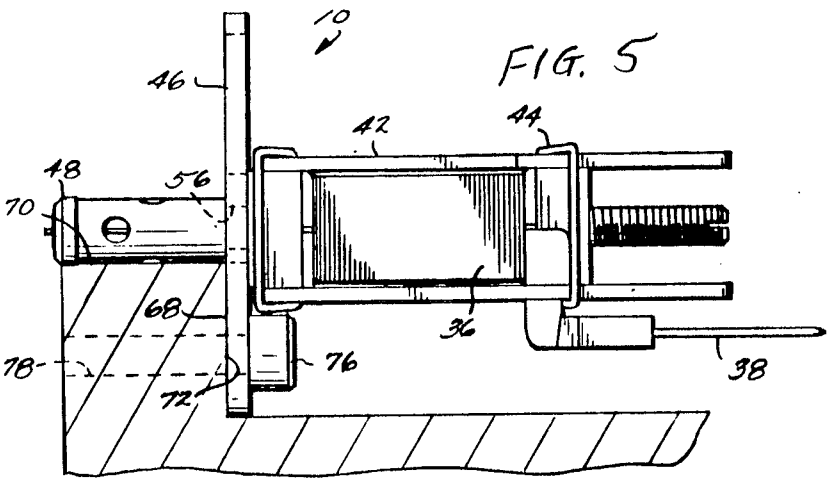
FIG. 5 is an enlarged fragmentary cross-sectional view of the carriage illustrating the mounting of the print head to the carriage.
Figure 4:
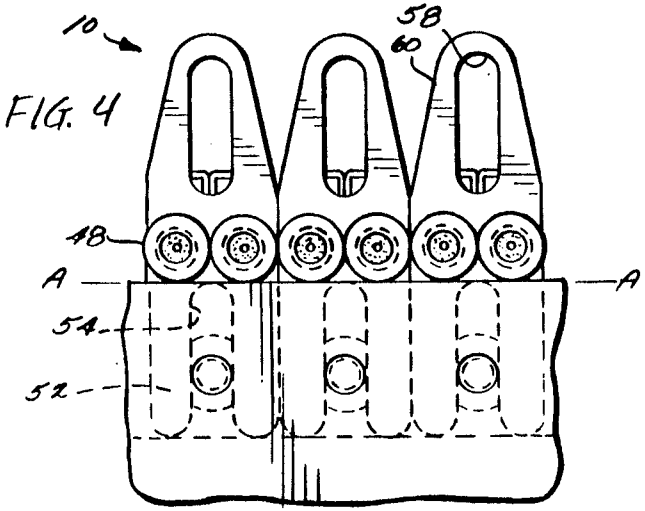
FIG. 4 is a fragmentary enlarged elevational view of several print heads mounted on a carriage and viewed from the print wire side of the carriage.

It will be appreciated from a review of FIG. 3 that, by threading wire guide support 48 about the exposed end of sleeve 26, the actuator and wire guide support 48 are clamped to and on opposite sides of the print head support 46. Also, it will be appreciated from a review of FIG. 4 that print heads 10 may be disposed in side-by side relation one to the other with the near wire guide supports 48 of the print heads lying in contact one with the other. From a review of FIGS. 4 and 5, it will be appreciated that a horizontal plane A—A (FIG. 4) passes through a tangent to each of the wire guide supports 48 along their undersides when a plurality of the print heads are disposed in side-by-side relation in assembly in carriage 12. Further, the plane A—A forms a predetermined angle with the flat, linear forward surface of print head support 46, particularly the lower flat surface 68. Preferably, the tangent plane A—A forms a right angle with the linear face 68 of print head support 46.

In order to mount the print head 10 such that the print wires project therefrom along a straight horizontal line on equal centerline-to-centerline spacing, the carriage 12 for mounting print heads 10 is provided with a pair of surfaces 70 and 72 disposed in the same angular relation as the tangent plane A—A is disposed relative to the linear surface 68 of print head support 46. Preferably, this angular relation in both cases is a right angle. Consequently, when each print head 10 is disposed on the carriage 12, more particularly, when the wire guide supports 48 are disposed on support surface 70 and the front surface 68 of print head support 46 bears against support surface 72, the two identically angled surfaces 70 and 72 of the carriage on the one hand and the correspondingly identically angled surfaces defined by the tangent plane A—A and surface 68, respectively, of the print head on the other hand ensure orientation of the print wires along a straight horizontal plane. That is, the tangent plane A—A coincides with the horizontal plane defined by surface 70 and the plane containing the linear surface 68 coincides with the vertical plane passing through support surface 72. A bolt 76 is provided for securing each print head 10 to carriage 12. Bolt 76 passes through the elongated slot 54 opening through the lower end of print head support 46 and into a bolt hole 78 formed in carriage 12. By disposing each print head on the carriage in this manner and connecting the print head to the carriage by bolt 76, pairs of print heads 10 are aligned horizontally relative to one another such that the print wires automatically lie along a straight line.

To ensure equal spacing between the print wires, an important feature of the present invention provides for a lateral dimension of each wire guide support 48 equal to the desired centerline-to-centerline spacing between the print wires 28. In the illustrated cylindrical form of the wire guide supports 48, the diameter of each support 48 is therefore equal to the centerline-to-centerline spacing of the print wires. By disposing the print heads 10 adjacent one another along carriage 12, with a wire guide support 48 of one print head 10 in contact with the adjacent wire guide support 48 of the adjacent print head, each print head may in turn be accurately spaced one from the other to provide equal centerline-to-centerline spacing of the print wires. In the illustrated preferred form, the side edges of the print head support 46 abut one another, but need not, and are preferably inset from the side edges of the wire guide supports 48 to preclude a tolerance buildup which might interfere with accurate spacing of the print wires. It will be appreciated, however, that the width of the print head supports 46 may be larger than the combined diameter of the pair of wire guide support whereby the width of the supports 46, rather than the diameter of the wire guide supports as preferred, may be determinative of the centerline spacing of the actuator wires.

It is also a feature of the present invention that the centerline-to-centerline spacing of the print wires may be increased or decreased by varying only the locations of the openings 56 of the print head supports 46, (and the size thereof as necessary to accommodate different spacing of openings 56) and the lateral dimension of the wire guide supports 48, i.e., their diameters. For example, for a larger spacing, the holes 56 through the print head supports 46 would be centered corresponding to the increased centerline-to-centerline spacing of the print wires. As in the previously described embodiment, the wire guide supports 48 would then be sized to diameters corresponding to the centerline-to centerline spacing. When the print heads are disposed on the shuttle carriage, the larger diameter wire support guides would then butt one another in a horizontal plane with the desired increased centerline-to-centerline spacing. To accommodate the relocation of the bolt 76 for securing the print head supports 46 to the carriage 12, various holes 78 may be provided along carriage 12 to accommodate several standard centerline-to-centerline spacings and at vertically staggered locations such that the bolt may pass through the elongated slot 54 for reception into the appropriate hole 78 for the predetermined centerline-to-centerline spacing.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a line matrix printer having a horizontal print line, a method of assembling first and second print heads on a support frame having a pair of elongated angularly related support surfaces, each print head having a print head support with a linear surface, an actuator carried by each said print head support and having an actuator wire and a wire guide support for said actuator wire mounted on said print head support and projecting therefrom to form a predetermined angle with the linear surface of the print head support, comprising the steps of:

mounting said first and second print heads on the support frame by engaging each wire guide support on one of said angularly related surfaces and aligning the axes of the actuator wires horizontally with the horizontal print line of the line matrix printer;

engaging the linear surfaces of said first and second print head supports against the other of said angularly related surfaces of the support frame;

engaging at least one of said print head support and aid wire guide support of said first print head with a corresponding one of said print head support and wire guide support of said second print head; and thereafter securing each print head support to the support frame.

2. A method according to claim 1 wherein each said print head has a pair of actuators each having an actuator wire and a wire guide support, the actuator wires being spaced on predetermined centerlines relative to one another, and including the step of forming each wire guide support in each print head with a lateral dimension in the direction of said one angularly related surface corresponding to the centerline spacing of the print wires.

3. A method according to claim 1 wherein said support frame surfaces are mutually perpendicular one to the other.

4. A method according to claim 1 wherein each of said first and second print heads has a pair of actuators each having an actuator wire and a wire guide support, the actuator wires being spaced on predetermined centerlines relative to one another and including the step of forming each wire guide support in each print head with a lateral dimension in the direction of said one angularly related surface corresponding to the centerline-to-centerline spacing of the print wires relative to one another.

5. A method according to claim 4 including providing each wire guide support in a cylindrical configuration with a diameter corresponding to the diameter of the centerline-to-centerline spacing of the print wires.

6. A method according to claim 5 including providing no more than two actuators and corresponding actuator wires and wire guide supports for each print head.

7. A method according to claim 1 wherein the step of securing each print head support to the support frame includes fixedly mounting each print head support to the support frame against movement.

8. A method of assembling a print head on a support frame having a pair of elongated angularly related support surfaces, the print head having a print head support with a linear surface, a pair of actuators carried by said print head support and each having an actuator wire and a wire guide support for said actuator wire mounted on said print head support and projecting therefrom to form a predetermined angle with the linear surfaces of the print head support, the actuator wires being spaced on predetermined centerlines relative to one another, comprising the steps of:

mounting the print head on the support frame by engaging the wire guide supports on one of said angularly related surfaces;

engaging the linear surface of the print head support against the other of said angularly related surfaces of the support frame;

forming each wire guide support with a lateral dimension in the direction of said one angularly related surface corresponding to the centerline spacing of the print wires; and thereafter securing the support frame and print head support one to the other.

9. A method of assembling first and second print heads on a support frame having a pair of elongated angularly related support surfaces, said first print head having a first print head support with a linear surface and a pair of actuators carried by said first print head support with each actuator having an actuator wire and a wire guide support for said actuator wire mounted on said print head support and projecting therefrom to form a predetermined angle with the linear surface of the print head support, said second print head having a second print head support with a linear surface and a pair of actuators carried by said second print head support with each actuator thereof having an actuator wire and a wire guide support for the actuator wire mounted on said second print head support and projecting therefrom to form a predetermined angle with the linear surface of said second print head support, the actuator wires of each of said first and second print heads being spaced on predetermined centerlines relative to one another, comprising the steps of:

mounting and aligning said first and second print heads alongside one another on the support frame by engaging the wire guide supports thereof on one of said angularly related surfaces;

engaging the linear surfaces of said first and second print head supports against the other of said angularly related surfaces of the support frame;

forming a wire guide support on each print head to have a lateral dimension in the direction of said one angularly related surface corresponding to the centerline-to-centerline spacing of the print wires relative to one another;

engaging at least one of said second print head support and said second wire guide support with a corresponding one of said first print head support and wire guide support of said first print head, respectively, the thereafter securing the support frame and said first and second print head supports one to the other.

10. A method according to claim 9 including providing each wire guide support in a cylindrical configuration with a diameter corresponding to the diameter of the centerline-to-centerline spacing of the print wires.

11. A method according to claim 10 including providing no more than two actuators and corresponding actuator wires and wire guide supports for each print head.

12. A print head for mounting on a support member comprising:

a pair of print head actuators, each said actuator carrying a print wire;

a print head support for mounting said pair of said actuators and having openings for receiving respective print wires;

a wire guide support for each actuator and having a passage therethrough for receiving the print wire;

means for securing said pair of actuators, said print head support, and said wire guide supports in assembly relative to one another with said pair of actuators on one side of said print head support with said print wires extending through said openings and said wire guide supports on the opposite side of said print head support from said actuators;

said wire guide supports lying in side-by-side relation one to the other defining a first plane passing along edge portions thereof, said print head support having a linear surface along said opposite side thereof defining a second plane angularly related to said first plane thereby enabling said print head for mounting on a support member having corresponding angularly related surfaces.

13. A print head according to claim 12 wherein said wire guide supports have a lateral dimension equal to the centerline-to-centerline spacing of said actuator wires whereby locating said wire guide supports in contact one with the other establishes the centerline-to-centerline spacing of said actuator wires.

14. A print head according to claim 12 wherein said print head support comprises a mounting plate with said openings therethrough for receiving the print wire actuators, respectively, means for clamping the actuators to said print head support and means carried by said print head support mounting plate for securing said mounting plate to the support member.

15. A print head according to claim 14 wherein said securing means includes means along said plate enabling said securing means to lie at adjusted positions along the support member.

16. A print head according to claim 12 wherein each said print head support carries no more than two actuators, said wire guide supports being cylindrical, said print head actuators being aligned along the support member with the centerlines of said actuator print wires defining a predetermined spacing of said print wires one from the other along said support member, said wire guide supports having a diameter equal to the predetermined spacing of said actuator wires.

17. A print head according to claim 12 in combination with said support member, said wire guide supports and said linear surface defining a right angle between said first and second planes, means cooperable between the support member and said print head support for mounting said print head on the support member with said wire guide supports and said linear surface engaging said mutually perpendicular surfaces of the support member.

18. A print head assembly for a dot matrix printer comprising:

a plurality of print heads;

each print head including a pair of print head actuators each carrying a print wire, a print head support for mounting said pair of said actuators and having openings for receiving respective print wires, means for securing said pair of actuators and said print head support one to the other on one side of said print head support with said print wires extending through said openings, a wire guide support for each actuator and having a passage therethrough for receiving the print wire and means for retaining said wire guide support on said print head support on the opposite side thereof from said actuator;

a support member having a pair of angularly related surfaces;

said print heads disposed in side by-side relation to one another on said support member;

said wire guide supports on each adjacent pair of print heads lying in side-by-side relation one to the other defining a first plane passing along edge portions thereof, each said print head support having a linear surface along said opposite side thereof defining a second plane angularly related to said first plane identically as said surfaces of said support member are angularly related to one another whereby said print heads are mounted on said support member with said edge portions of said wire guide supports and said linear surfaces engaging the corresponding angularly related surfaces of said support member.

19. A print head according to claim 18 wherein each said wire guide support has a lateral dimension equal to the centerline-to-centerline spacing of said actuator wires whereby locating said wire guide supports in contact one with the other establishes the centerline-to-centerline spacing of said actuator wires.

20. A print head according to claim 18 wherein each said print head support comprises a mounting plate with said openings therethrough for receiving the print wire actuators, respectively, means for clamping the actuators to said print head support and means carried by said print head support mounting plate for securing said mounting plate to said support member.

21. A print head according to claim 20 wherein said securing means includes means along each said plate enabling said securing means to lie at adjusted positions along the support member.

22. A print head according to claim 18 wherein each said print head support carries no more than two actuators, said wire guide supports being cylindrical, said print head actuators being aligned along said support member with the centerlines of said actuator print wires defining a centerline-to-centerline spacing of said print wires one from the other along said support member, said wire guide supports having a diameter equal to the predetermined spacing of said actuator wires whereby locating said wire guide supports in contact one with the other establishes the centerline-to-centerline spacing of said actuator wires.

23. A print head according to claim 18 wherein said wire guide supports and said linear surface of each print head support defines a right angle between said first and second planes, means cooperable between the support member and each said print head support for mounting said print heads on the support member with said wire guide supports and said linear surfaces engaging said mutually perpendicular surfaces of the support member.

* * * * *